US007708679B2

(12) United States Patent
Cailloux et al.

(10) Patent No.: US 7,708,679 B2
(45) Date of Patent: May 4, 2010

(54) FOLDING DEVICE FOR A FOLDING AND GLUING MACHINE

(75) Inventors: Lionel Cailloux, Thonon les Bains (FR); Roger Dupertuis, La Praz (CH)

(73) Assignee: Bobst S.A. (CH)

( * ) Notice: Subject to any disclaimer, the term of this patent is extended or adjusted under 35 U.S.C. 154(b) by 89 days.

(21) Appl. No.: 11/972,330

(22) Filed: Jan. 10, 2008

(65) Prior Publication Data

US 2008/0171644 A1 Jul. 17, 2008

(30) Foreign Application Priority Data

Jan. 17, 2007 (EP) ..... 07000940

(51) Int. Cl.
*B31B 1/36* (2006.01)

(52) U.S. Cl. ..... 493/401; 493/416; 493/438; 493/442; 493/460

(58) Field of Classification Search ..... 493/397, 493/399, 401, 416, 436, 438, 442, 443, 446, 493/454, 455, 460
See application file for complete search history.

(56) References Cited

U.S. PATENT DOCUMENTS 1,104,013 A * 7/1914 Staude ..... 493/179
2,701,989 A * 2/1955 Hayward et al. ..... 493/302
2,783,693 A * 3/1957 Felber ..... 493/135
2,896,517 A * 7/1959 Labombarde ..... 493/408
2,986,078 A * 5/1961 Hottendorf ..... 493/179
3,122,069 A * 2/1964 Lopez ..... 493/423
3,266,391 A * 8/1966 Lopez ..... 493/438
3,297,315 A * 1/1967 Kunz ..... 493/438
4,012,996 A 3/1977 Stolkin et al.
4,041,849 A * 8/1977 Tsukasaki ..... 493/436
4,187,769 A * 2/1980 Bullock ..... 493/438
4,557,714 A * 12/1985 Sabelstrom et al. ..... 493/442
4,606,784 A * 8/1986 Glans et al. ..... 156/200
4,614,512 A * 9/1986 Capdeboscq ..... 493/441
4,624,653 A * 11/1986 McBride et al. ..... 493/127
4,656,858 A * 4/1987 Addison ..... 72/181
4,787,232 A * 11/1988 Hayes ..... 72/176
4,875,668 A * 10/1989 Spyra ..... 270/45
5,114,392 A * 5/1992 McAdam et al. ..... 493/179
5,246,416 A * 9/1993 Demura et al. ..... 493/439
5,690,601 A * 11/1997 Cummings et al. ..... 493/340
5,797,831 A * 8/1998 Roberts et al. ..... 493/438
5,800,329 A * 9/1998 Fager et al. ..... 493/417

(Continued)

FOREIGN PATENT DOCUMENTS

EP 0 391 118 10/1990

(Continued)

OTHER PUBLICATIONS

European Search Report dated Mar. 28, 2007 issued in corresponding European Patent Application No. 07 00 0940.

*Primary Examiner*—Paul R Durand
(74) *Attorney, Agent, or Firm*—Ostrolenk Faber LLP

(57) ABSTRACT

Folding device for folding blanks, including an internal tool fit to cooperate with an external tool for forming a longitudinal fold in a blank, and a supporting guide fit to cooperate with the internal tool to sandwich the fold as the external tool folds the blank as the blank is conveyed.

10 Claims, 6 Drawing Sheets

U.S. PATENT DOCUMENTS 5,827,162 A * 10/1998 Rubin et al. ..... 493/178
5,997,459 A * 12/1999 Kruger et al. ..... 493/441
6,017,298 A * 1/2000 Baron ..... 493/166
6,419,079 B1 * 7/2002 Diehr ..... 198/626.1
6,562,171 B1 * 5/2003 Archie et al. ..... 156/204
6,712,748 B2 * 3/2004 Trennepohl ..... 493/423
6,808,479 B2 * 10/2004 Trovinger et al. ..... 493/442

FOREIGN PATENT DOCUMENTS

EP 0 724 954 8/1996
EP 1 398 142 3/2004

* cited by examiner

A-A

B-B

C-C

FOLDING DEVICE FOR A FOLDING AND GLUING MACHINE

TECHNICAL FIELD

The present invention concerns a folding device for folding a blank of paper, cardboard, plastic, corrugated board or similar material used to form a folded box.

The present invention also concerns a folding and gluing machine including a folding device according to the invention.

BACKGROUND ART

To carry out folding a folded box of a given material, it is known to convert a blank of said material in a machine called a <<folder-gluer>>.

A blank is usually composed of two large faces, a first face called an internal face, intended to shape the inside of the folded box and a second face called an external face, intended to shape the outside of the box.

With regard to the running direction of the blanks in the folder-gluer, the front edge of the blank is the transverse side of the blank which first enters into the machine and the rear side is the one which last enters. Likewise, the left edge of the blank is the lateral side of the blank located at the left side of the longitudinal axis of the folder-gluer and the right edge is the lateral side of the blank located at the right side of the longitudinal axis of the folder-gluer.

In a folder-gluer machine, the folding operation of a blank is achieved during its conveying through the folder-gluer, using folding tools working together on each side of the blank. The tool located on the side of the internal face of the blank is called an internal tool and the tool located on the side of the external face of the blank is called an external tool.

At the end of a folding operation, the blank is divided into three longitudinal adjacent parts: a first panel, a fold and a second panel folded down onto the first panel. For convenience, this terminology will be used for a blank, i.e. before the folding operation. The first panel is linked to the second panel by the fold defined by an axis and a radius. The axis and the radius of the fold are respectively called its folding axis and its folding radius.

Usually, a conveyor conveys the blank along a substantially planar path from the inlet towards the outlet of the folder-gluer. During the folding operation, the internal tool is pressing against the internal face of the blank along the longitudinal fold and the external tool is pressing against the external face of the first panel. During the conveying of the blank, the external tool exerts onto the first panel a bending force which is applied on the front edge of the panel for causing the rotation of the first panel around the folding axis. In this known folding process, the position and the geometry of the fold are difficult to control, particularly when folding between 0 and 90°, which causes variations in the production of the folded boxes and thus quality problems. These problems are particularly acute when the panel to be folded is stiff, as is notably the case when the blank is a corrugated board blank.

SUMMARY OF THE INVENTION

An object of the present invention is to improve the folding of a blank in a folder-gluer. To this end, the present invention refers to a folding device for folding blanks, including an internal tool fit to cooperate with an external tool for forming a longitudinal fold in a blank, and a supporting guide fit to cooperate with the internal tool to sandwich the fold as the external tool folds the blank as the blank is conveyed. The supporting guide may have a longitudinal surface of a helical shape. The internal tool may be a longitudinal ramp which may be comprised of a plurality of rollers.

Owing to this new design, the fold is guided and supported during its forming. That allows stabilizing the position and the geometrical characteristics of the fold and thus improves the quality of the folded boxes.

Other features and advantages of the invention will be more clearly understood from the description of embodiments which refers to the accompanying drawings.

DESCRIPTION OF A PREFERRED EMBODIMENT OF THE INVENTION

Figure 1A:
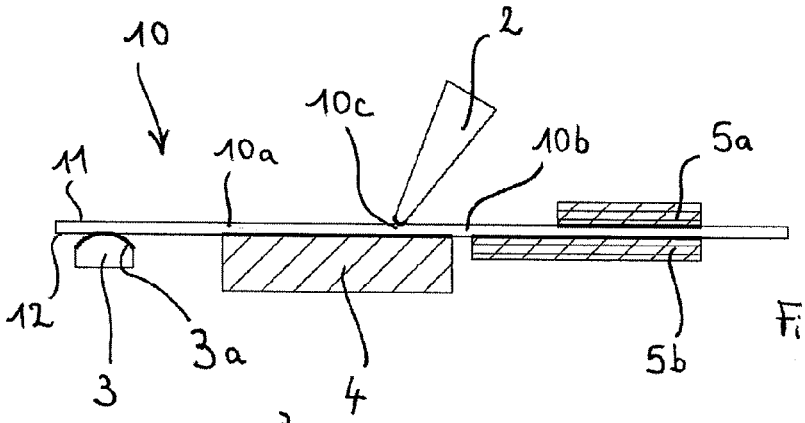
FIGS. 1*a*-*c* are transverse sectional views of a portion of a blank and of the device according to the invention, according to the sectional planes of FIG. 3.
Figure 1B:
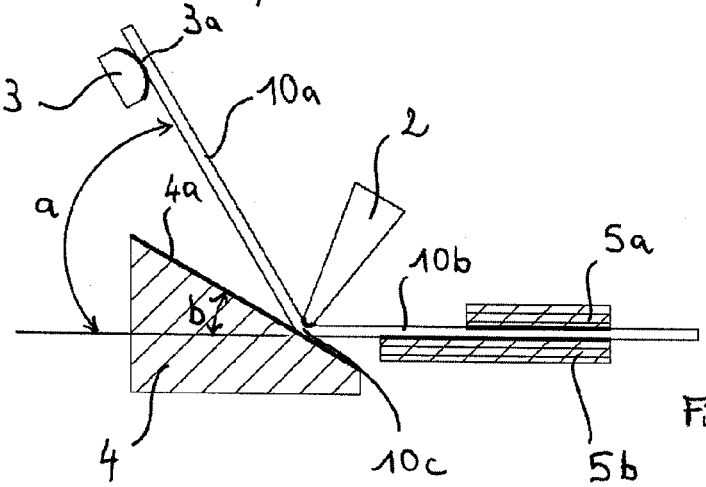
Figure 1C:
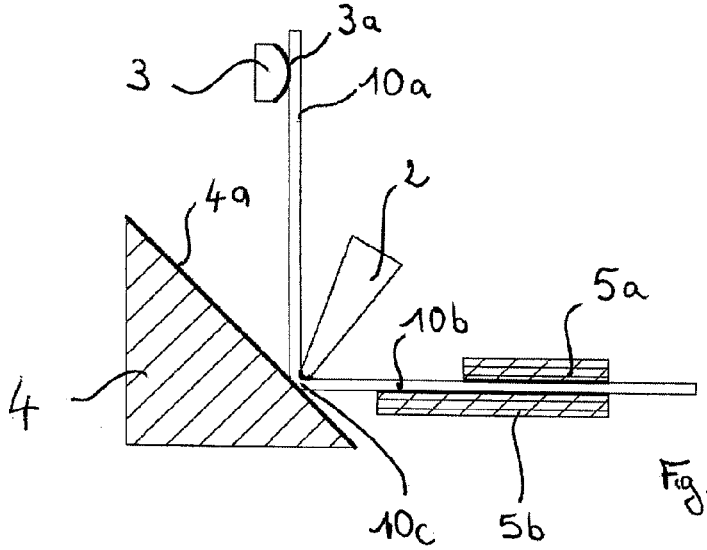

FIGS. 1*a*-1*c* illustrate in a simplified manner a folding device according to the invention as well as an example of the folding operation of a blank 10. The blank 10 includes an internal face 11 and an external face 12. It also includes three adjacent longitudinal parts: a first panel 10*a*, a fold 10*c* and a second panel 10*b*. In the example, an opposing belt conveyor 5*a*, 5*b* conveys the blank 10 in a horizontal plane, according to a substantially rectilinear path 6 (see FIG. 3). The belt conveyor includes an upper conveyor 5*a* and a lower conveyor 5*b*. To convey the blank 10, the second panel 10*b* is clamped between the belts of the upper 5*a* and the lower conveyor 5*b*.

FIG. 1*a* illustrates the blank 10 at the inlet of the device according to the invention. In that position, the blank 10 is planar, i.e. the three respective longitudinal parts 10*a*, 10*c*, 10*b* of the blank are in a common horizontal plane. An internal folding tool 2 is pressing against the blank at the location of the longitudinal fold 10*c*, on the side of the internal face 11 of the blank. In the example, the internal tool 2 has the form of a ramp of rollers (see FIG. 5 for more details) oriented longitudinally. A surface 3*a* of an external folding tool 3 is pressing against the external face of the first panel 10*a*, preferably, close to the left edge of the blank. In the example, the external tool 3 is a folding blade made of synthetic material from a twisted stick following a left curve so that the surface 3*a* forms a helicoid. The said helicoid 3*a* has an axis which coincides with the folding axis (see FIG. 3). During the running of the blank, the blade 3 applies to the panel 10*a* a bending force which applies to the front edge of the blank.

According to the invention, the device includes a supporting guide 4. During the folding operation, the supporting guide 4 is pressing against the longitudinal fold 10*c*, on the side of the external face 12 of the blank, so that the fold 10*c* is sandwiched between the internal tool 2 and the supporting guide 4. In the example, the supporting guide 4 is a metallic bar having a longitudinal surface machined to have a helical shape 4*a*. The generatrix of the helical surface 4*a* is a line segment which turns around an axis coinciding with the folding axis of the fold 10*c*.

In the position of FIG. 1*a*, the intersection of the transverse sectional plane with the helical surface 4*a* is a horizontal line segment.

FIG. 1*b* illustrates the blank 10 located in the second half of the device according to the invention. In that position, the blank 10 is V-shaped, the second panel 10*b* is still horizontal whereas the first panel 10*a* is inclined by an angle "a" with respect to the horizontal, with "a" illustrated equal to 60°. The internal folding tool 2 is still pressing at the location of the longitudinal fold 10*c*, on the side of the internal face 11 of the blank and the external folding tool 3 is still pressing against the external face of the first panel 10*a*. The supporting guide 4 is still pressing against the longitudinal fold 10*c*, on the side of the external face 12 of the blank. In that position, the intersection of the transverse sectional plane with the helical surface 4*a* is a line segment inclined by an angle "b" with respect to the horizontal, with "b" equal to 30°.

FIG. 1*c* illustrates the blank 10 at the outlet of the device according to the invention. In that position, the blank 10 has the shape of a square, the second panel 10*b* is still horizontal whereas the angle "a" of the first panel 10*a* is equal to 90°. The internal folding tool 2 is still pressing at the location of the longitudinal fold 10*c*, on the side of the internal face 11 of the blank and the external folding tool 3 is still pressing against the external face of the first panel 10*a*. The supporting guide 4 is still pressing against the longitudinal fold 10*c*, on the side of the external face 12 of the blank. In that position, the angle "b" of the line segment formed at the intersection of the transverse sectional plane with the helical surface 4*a*, is equal to 45°.

The example illustrated in FIGS. 1*a*-1*c* shows the folding of a blank in only three positions, it goes without saying as the folding is continuous that the angles "a" and "b" vary in a continuously increasing manner during the running of the blank through the folding device according to the invention. In the example, the angle "a" is equal to twice the angle "b". In other words, as the angle "a" varies from 0 to 90° the angle "b" varies proportionally from 0 to 45°.

Figure 2A:
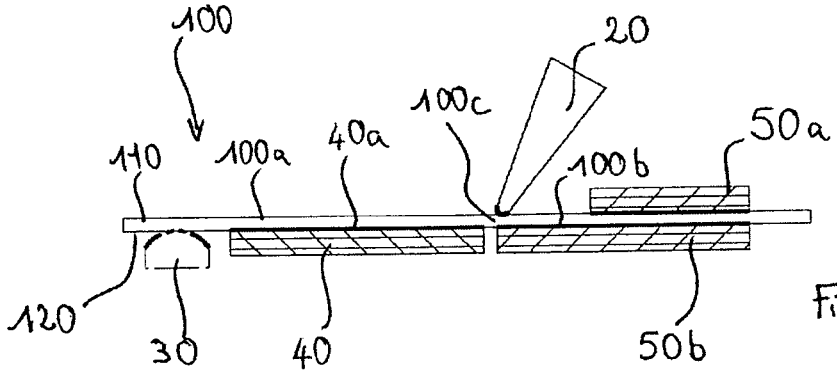
Fig. 2a PRIOR ART
FIGS. 2*a*-2*c* are views similar to those of FIGS. 1*a*-1*c*; illustrating a portion of a blank and of the device according to prior art.
Figure 2B:
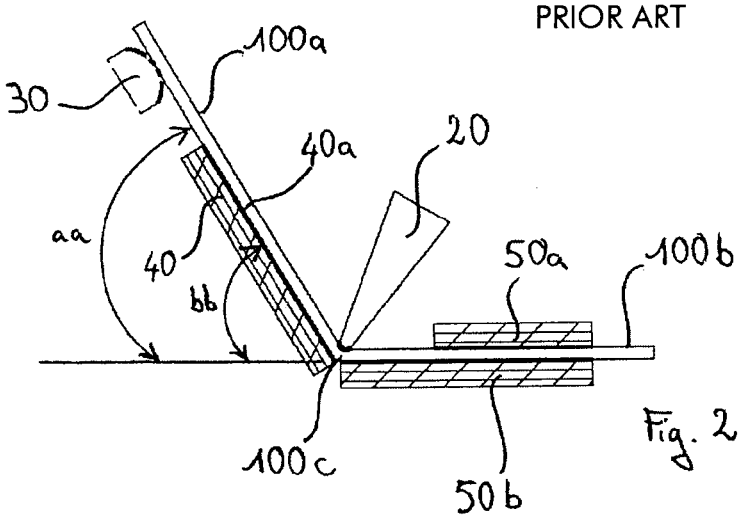
Fig. 2b PRIOR ART
Figure 2C:
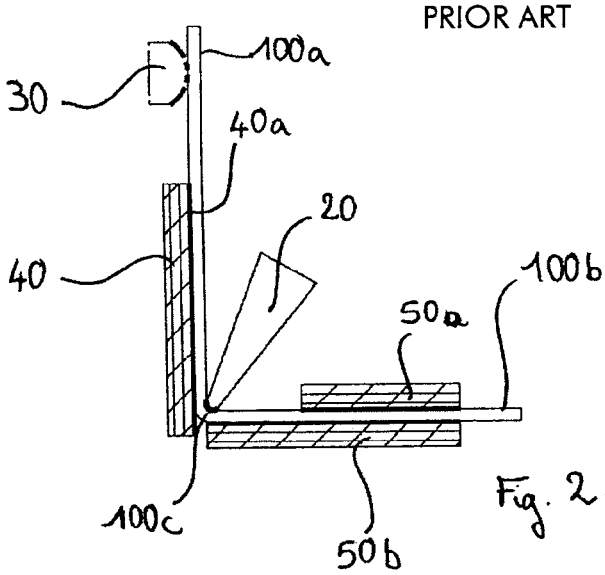
Fig. 2c PRIOR ART

FIGS. 2*a*-2*c* illustrates in a simplified manner a folding device according to prior art as well as an example of folding a blank 100. For comparison, the transverse sectional planes are identical to the preceding ones in FIG. 1. The blank 100 includes an internal face 110 and an external face 120, it also includes three longitudinal adjacent parts: a first panel 100*a*, a fold 100*c* and a second panel 100*b*. A belt conveyor 50*a*, 50*b* conveys the blank 100 in a horizontal plane, according to a substantially rectilinear path. The belt conveyor includes an upper conveyor 50*a* and a lower conveyor 50*b*. To convey the blank 100, the second panel 100*b* is clamped between the belts of the upper conveyor 50*a* and the lower conveyor 50*b*.

FIG. 2*a* illustrates the blank 100 at the inlet of a device according to prior art. In that position, the blank 100 is planar, i.e. the three respective longitudinal parts 100*a*, 100*c*, 100*b* of the blank are in the same horizontal plane. An internal folding tool 20 is pressing at the location of the longitudinal fold 100*c*, on the side of the internal face 110 of the blank. An external folding tool 30 is pressing against the external face of the first panel 100*a*, close to the left edge of the blank. During the running of the blank, the external folding tool 30 applies onto the panel 100*a* a bending force which applies to the front edge of the blank.

In prior art, a folding guide 40 is pressing against the external face of the first panel 100*a*, close to the longitudinal fold 100*c*, without being in contact with the said fold. Likewise, the belt of the lower conveyor 50*b*, is pressing against the external face of the second panel 100*b* close to the longitudinal fold 100*c*, without being in contact with the said fold. It can thus be noted that the fold 100*c* is not supported on the side of the external face 120.

The fact that the fold is not supported during its forming does not allow to control the folding operation with accuracy, which means that the geometrical characteristics of the fold such as for example the position of the folding axis, the folding radius, may vary from one blank to the other, which is not acceptable for the quality of the production. In prior art, the folding guide 40 is a folding belt, the surface of the belt which is in contact with the external face of the first panel 100*a* is designated as 40*a*. In the position of FIG. 2*a*, the intersection of the transverse sectional plan with the surface 40*a* is a horizontal line segment.

FIG. 2*b* illustrates the blank 100 in another position of the device according to prior art. In that position, the blank 100 is V-shaped, the second panel 100*b* is still horizontal whereas the first panel 100*a* is inclined by an angle "aa" with respect to the horizontal, with "aa" equal to 60°. The internal folding tool 20 is pressing a the location of the longitudinal fold 100*c*, on the side of the internal face 110 of the blank and the external folding tool 30 is pressing against the external face of the first panel 100*a*, close to the left edge of the blank. In prior art, the folding guide 40 is pressing against the external face of the first panel 100*a*, close to the longitudinal fold 100*c*, without being in contact with the said fold. In that position, the intersection of the transverse sectional plane with the surface 40*a* is a line segment inclined by an angle "bb" with respect to the horizontal, with "bb" equal to 60°.

FIG. 2*c* illustrates the blank 100 at the outlet of the device according to prior art. In that position, the blank 100 has a square corner, the second panel 100*b* is horizontal whereas the angle "aa" of the first panel is equal to 90°. The internal folding tool 20 is pressing at the location of the longitudinal fold 100*c*, on the side of the internal face 110 of the blank and the external folding tool 30 is pressing against the external face of the first panel 100*a*, close to the left edge of the blank. In prior art, the folding guide 40 is pressing against the external face of the first panel 100*a*, close to the longitudinal fold 100*c*, without being in contact with the said fold. In that position, the angle "bb" of the line segment formed at the intersection of the transverse sectional plane with the surface 40*a* is equal to 90°.

The prior art illustrated in FIGS. 2*a*-2*c* shows the folding of a blank only in three positions, it goes without saying as the folding operation is continuous that the angles "aa" and "bb" vary in a continuously increasing manner during the running of the blank. Moreover, the belt 40 follows the panel 110 during the whole folding operation, in other words the surface 40*a* remains in contact with the external face of the first panel 100*a* during the folding operation, consequently, the angle "aa" is equal to the angle "bb".

Figure 3:
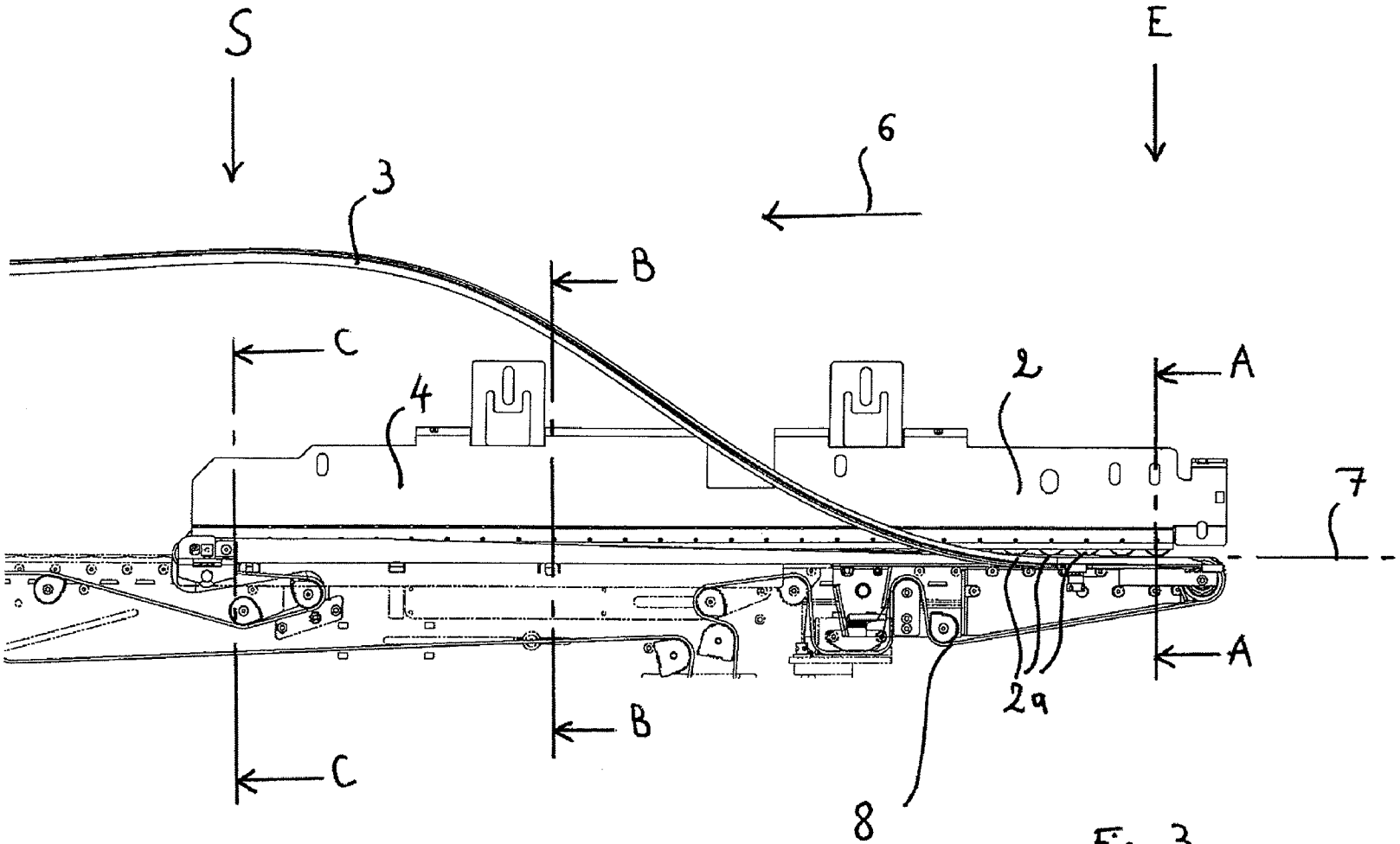
FIG. 3 is a front view of the device according to the invention.

FIG. 3 illustrates a front view of a folding device according to the invention. The arrow 6 shows the running direction of the blanks in the folder-gluer, that direction is parallel to the longitudinal axis of the folder-gluer. The arrow E shows the inlet of the device and the arrow S shows the outlet. Between the inlet E and the outlet S, the folding blade 3 forms a first blade portion of the axis 7 for folding the panel 10*a* of 0 to 90°. The axis 7 is the folding axis of the blank 10. After the outlet S, the folding blade 3 is elongated by a second blade portion, complementary to the first, for folding the panel 10*a* of 90° to 180° (see in particular FIG. 4). Alternatively, the folding of 90° to 180° can be carried out by a folding belt (not shown).

Between the inlet E and the outlet S, the angle formed between the generatrix of the helical surface 4*a* and the horizontal plane varies in a continuously increasing manner between 0° at the inlet E and 45° at the outlet S. The ramp 2 of rollers includes a plurality of rollers 2*a* aligned on an axis parallel to the folding axis 7. In a device according to the invention, the fold 10*c* can be sandwiched between the internal tool 2 and the supporting guide 4. To do so, the contact points of the rollers 2*a* with the internal face 11 of the fold 10*c* are opposite to the contact line of the helical surface 4*a* with the external face 12 of the fold 10*c*.

Figure 7:
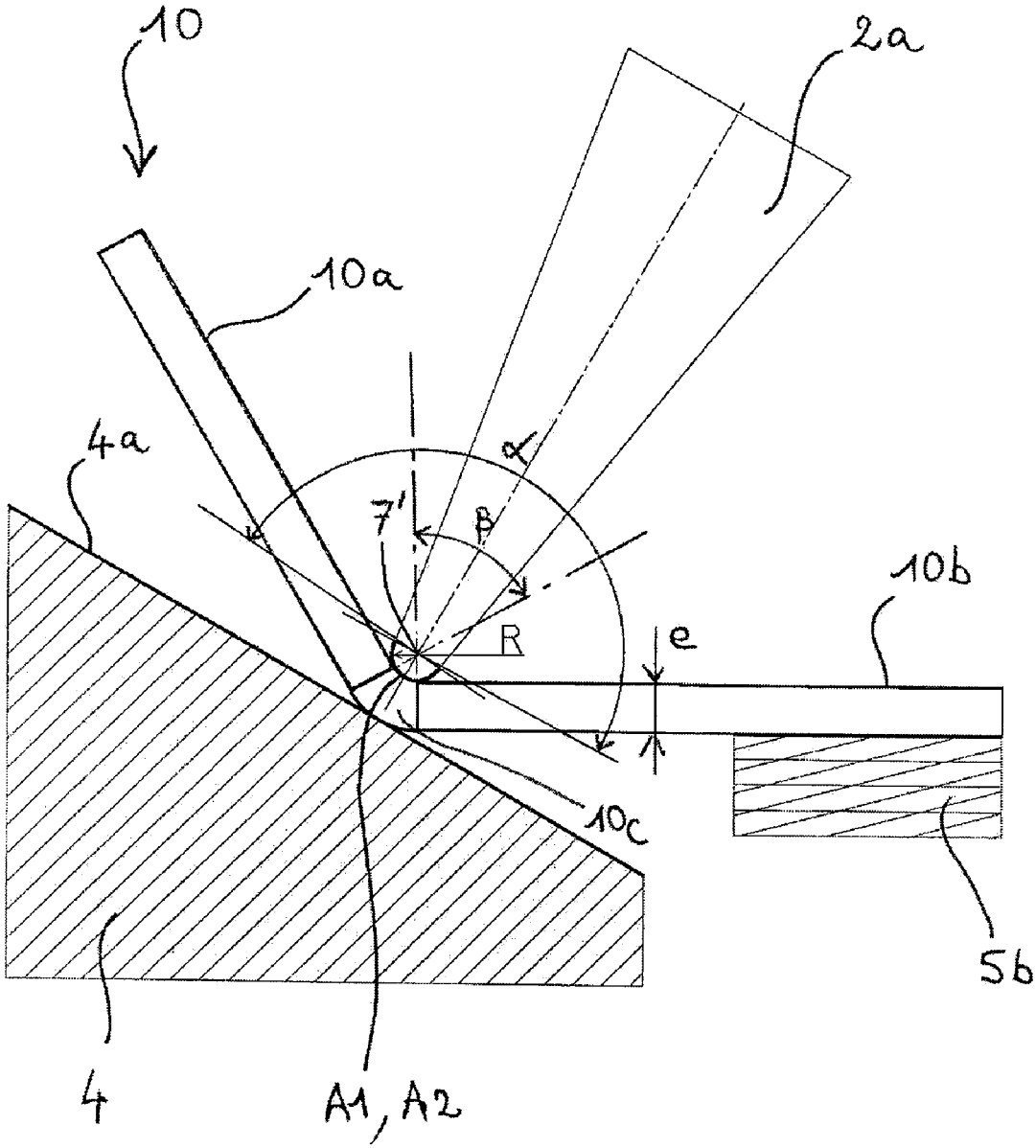
FIG. 7 is a transverse sectional view of a portion of a blank and of the device according to the invention.

The distance which separates the said contact points of the rollers 2*a* from the said contact line of the helical surface 4*a* is adjustable according to the thickness "e" of the blank to be folded (see FIG. 7).

Advantageously, a conveying belt 8 is guided along the helical surface 4*a* so that the fold 10*c* of the blank can be sandwiched between the internal tool 2 and the said belt 8. In that embodiment, the supporting guide 4 includes the conveying belt 8, which takes the shape of the helical surface 4*a*.

Figure 4:
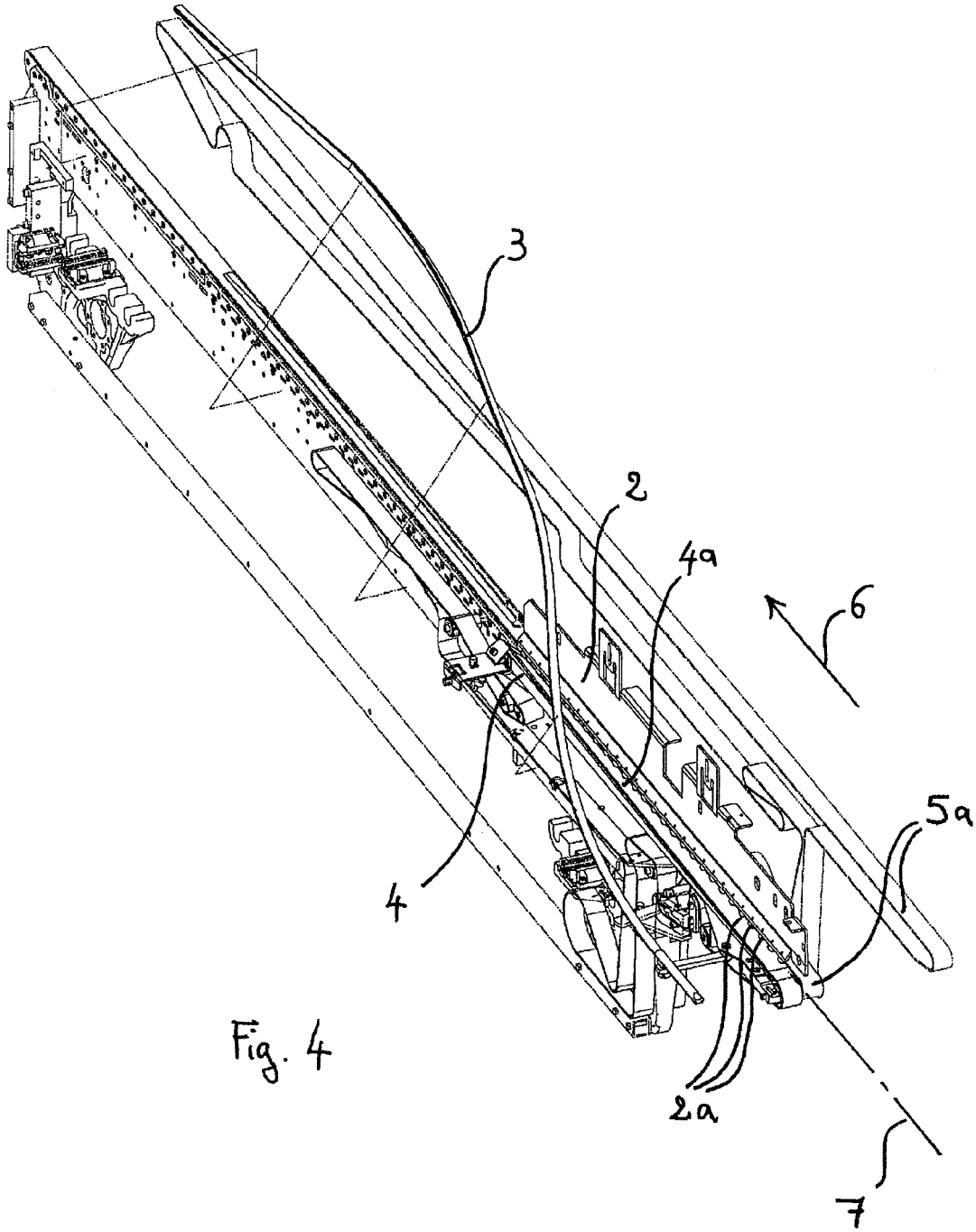
FIG. 4 is a perspective view of the device according to the invention with a portion of a folder-gluer.

FIG. 4 illustrates a folding device according to the invention and a portion of the folder-gluer. For clarity reasons, the upper conveyor 5*a* is not shown, only two belts of the lower conveyor 5*b* are shown. The folding blade 3 is entirely shown. In a device according to the invention, a blank 10 which arrives at the inlet E is sandwiched between the rollers 2*a* of the ramp 2 and the helical surface 4*a*, at the place where the longitudinal fold 10*c* must be formed. Leaving the device, the blank 10 is folded at 90°, in other words, the first panel 10*a* forms a right angle with the second panel 10*b*. The following folding operation, i.e. folding the first panel 10*a* of 90° to 180°, being carried out in a conventional manner, will not be described here.

Figure 5:
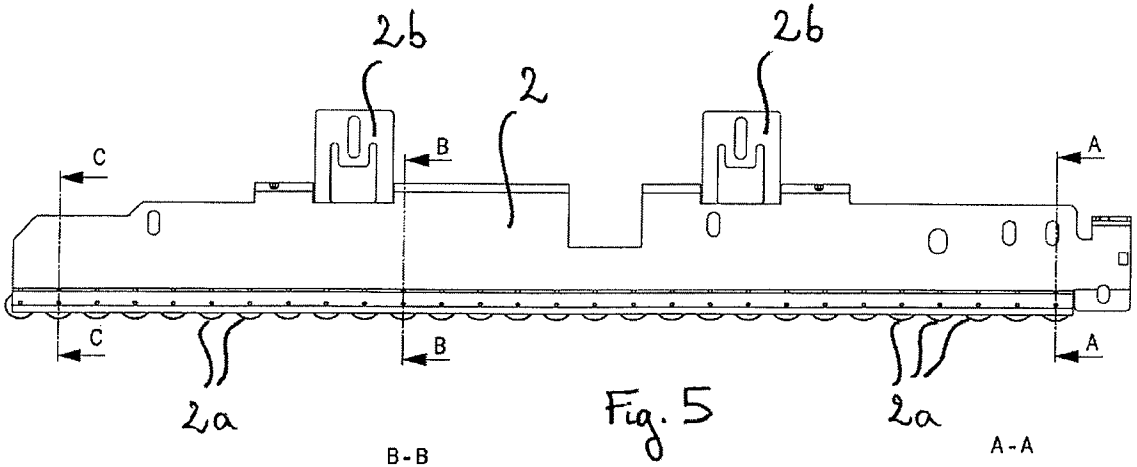
FIG. 5 is a front view of the internal tool.

FIG. 5 illustrates a ramp 2 of rollers used as internal tool. That ramp has a plurality of identical rollers 2*a*. Each roller 2*a* is mounted free rotatably around an axis 2*c* (see FIGS. 6*a*-6*c*). All the axes 2*c* are in a same longitudinal plane. Brackets 2*b* are intended to mount the ramp 2 onto the folder-gluer.

Figure 6A:
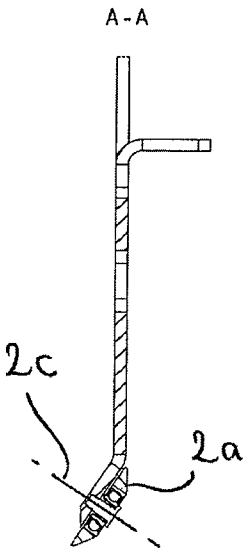
FIGS. 6*a*-6*c* are transverse sectional views of the internal tool according to the sectional planes of FIG. 5.
Figure 6B:
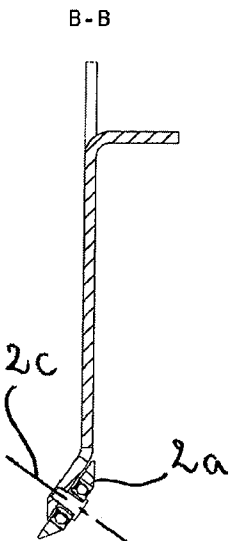
Figure 6C:
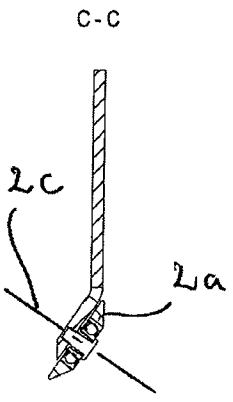

FIGS. 6*a*-6*c* illustrate the ramp 2 in a transverse sectional view according to the sectional plans A-A, B-B and C-C of FIG. 5. These sectional plans are identical to the sectional plans of FIG. 3. The inclination of the rotation axis 2*c* of the rollers 2*a* with respect to the horizontal is constant from one roller to the other over the whole length of the ramp 2.

FIG. 7 illustrates in a transverse section according to the-sectional plan B-B, the contact points of a roller 2*a* with the fold 10*c* of a blank 10 sandwiched between the internal tool 2 and the supporting guide 4. The periphery of the roller 2*a* has a rounded shape. That rounded shape is an arc of a circle A1 with a radius R, of a center 7' and of an angle α. The radius R is the folding radius of the fold 10*c*. In the example R is equal to 0.75 mm and α is equal to 150°. The straight line passing through the center 7' of all the rollers 2*a* defines the folding axis 7. The contact points of the roller 2*a* with the blank 10 thus form an arc of a circle A2 contained in A1, in other words, the radius and the center of A2 are the same as for A1, but the angle of A2 is less than the angle of A1, that is to say β is the angle of A2. The angle β can also be defined as being the angle of the arc of a circle obtained by the projection of the contact points of the roller 2*a* in a normal plane to the running direction of the blank.

Advantageously, the bisecting line of the angle β is orthogonal to the line segment formed at the intersection of the-sectional plan B-B with the helical surface 4*a*. That feature can be seen on all the transverse sections along the folding device according to the invention. Owing to that feature, the fold 10*c* is guided at all the steps of its forming.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A folding device for folding a foldable blank having an internal surface and an external surface, the folding device comprising:

a conveyor configured to convey the blank through the folding device in a conveying direction;

an internal tool positioned and configured to guide the internal surface of the blank;

an external tool positioned and configured to guide the external surface of the blank and positioned opposite the internal tool;

the internal tool being configured to oppose and to cooperate with the external tool to form a longitudinal fold in and along the blank in the conveying direction as the blank is conveyed past the external tool, and the external tool being positioned and configured to fold the blank when the blank is conveyed past the external tool; and a supporting guide contacting the external face of the foldable blank, comprising a longitudinal surface having a helical shape in the conveying direction and being configured to cooperate with the internal tool for sandwiching the fold.

2. The device according to claim 1 wherein the internal tool is positioned and configured to press against the internal surface of the blank at the internal surface of the longitudinal fold, the external tool is positioned and configured to press against the external surface of the blank, and the supporting guide is positioned and configured to press against the external surface of the longitudinal fold.

3. The device according to claim 2, wherein the internal tool is a longitudinal ramp comprised of a plurality of rollers.

4. The device according to claim 3, wherein the rollers include contact points positioned and configured to make contact with the internal surface of the fold, and the contact points are positioned opposite to the contact line of the helical surface with the external face of the fold.

5. The device according to claim 4, wherein a distance between the contact points of the rollers with the fold and the contact line of the helical surface is adjustable according to a thickness of the blank.

6. The device according to claim 4, wherein a projection of the contact points of a roller in a plane normal to the conveying direction of the blank forms an arc of a circle extending over an angle β.

7. The device according to claim 6, wherein an intersection of a transverse sectional plane with the helical shape longitudinal surface forms a line segment and the bisecting line of the angle β is orthogonal to the line segment.

8. The device according to claim 1, wherein the helical shape longitudinal surface is formed by a generatrix turning around the folding axis of the fold.

9. The device according to claim 1, wherein an intersection of a transverse sectional plane with the helical shape longitudinal surface forms a line segment.

10. The device according to claim 1, wherein the supporting guide includes a conveying belt.

* * * * *